United States Patent [19]

Körkemeier et al.

[11] Patent Number: 4,561,387

[45] Date of Patent: Dec. 31, 1985

[54] LIQUID COOLING SYSTEM FOR A TURBOCHARGED INTERNAL COMBUSTION ENGINE

[75] Inventors: Hans Körkemeier, Achern; Walter Martschik, Unterriexingen; Josef Klieber, Löchgau, all of Fed. Rep. of Germany

[73] Assignee: Dr. Ing.h.c.F. Porsche Aktiengesellschaft, Fed. Rep. of Germany

[21] Appl. No.: 639,089

[22] Filed: Aug. 9, 1984

[30] Foreign Application Priority Data

Mar. 1, 1984 [DE] Fed. Rep. of Germany ..... 3407521

[51] Int. Cl.[4] ..... F01P 3/12

[52] U.S. Cl. ..... 123/41.31; 60/599; 165/128

[58] Field of Search ..... 123/41.31, 41.01, 41.29, 123/41.44; 165/128, 130, DIG. 16; 60/599

[56] References Cited

U.S. PATENT DOCUMENTS 4,362,131 12/1982 Mason et al. ..... 123/41.31

4,385,594 5/1983 Hauser, Jr. ..... 123/41.29

*Primary Examiner*—William A. Cuchlinski, Jr.

*Attorney, Agent, or Firm*—Craig & Burns

[57] ABSTRACT

A liquid cooling system for a super-charged internal combustion engine in which the turbocharger is connected to the forced circulatory cooling system effective during the operation of the engine. In order to prevent an overheating of the turbocharger after the internal combustion engine is turned off, the turbocharger is equipped with a further cooling circulatory system maintained by thermo-syphoning action. A volume expansion tank present in the cooling circulatory system of the internal combustion engine is thereby used as heat exchanger for cooling off the cooling liquid, which is constructively matched for this particular application.

20 Claims, 1 Drawing Figure

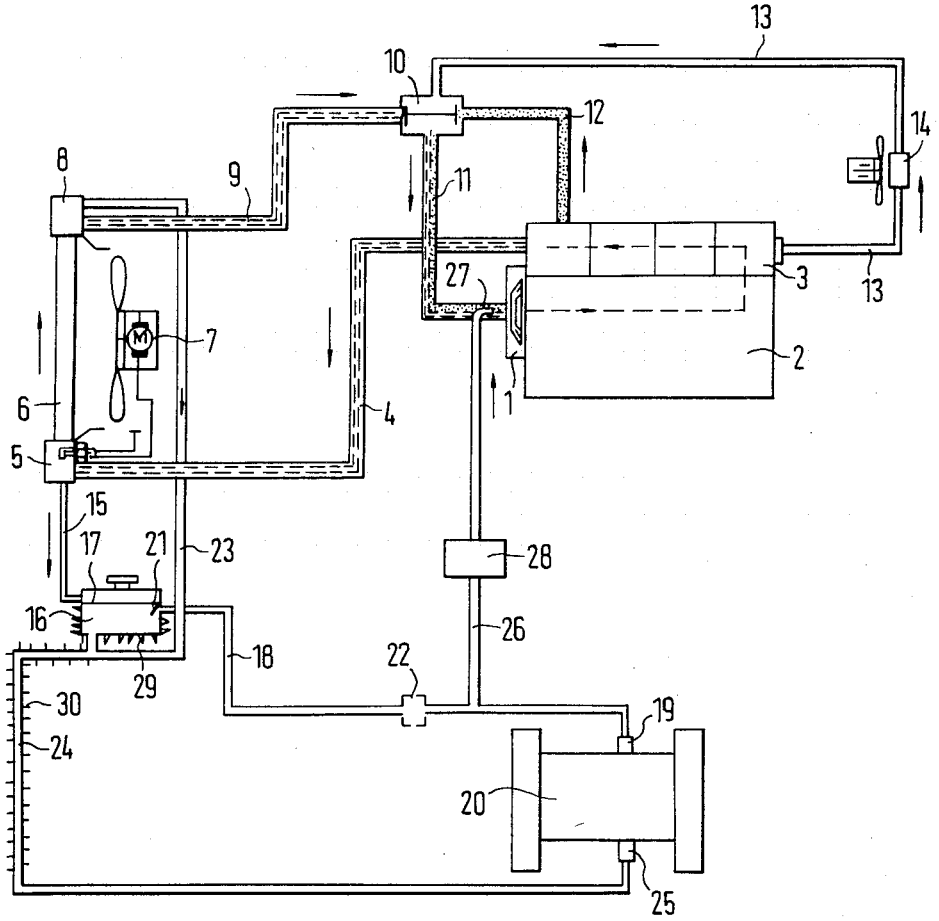
13
10
12
14
8
9
11
3
13
27
7
2
1
6
4
5
15
17
21
23
28
16
26
18
22
29
30
19
24
20
25

LIQUID COOLING SYSTEM FOR A TURBOCHARGED INTERNAL COMBUSTION ENGINE

The present invention relates to a liquid cooling system for an internal combustion engine supercharged by a turbocharger, in which the turbocharger is connected to the forced circulation, brought about by pump pressure between a radiator and an internal combustion engine.

Such a cooling system which is disclosed in the German Offenlegungsschrift 2,825,945, entails the disadvantage that it is effective only as long as the internal combustion engine is in operation. After turning off the internal combustion engine, the temperature in the turbocharger rises to values between 300° C. and 400° C. with the consequence that its bearing oil cokes and becomes gummy and a premature failure of the turbocharger occurs as a result thereof.

It is the object of the present invention to provide a cooling system which remains effective also after turning off the internal combustion engine.

The underlying problems are solved according to the present invention in that the turbocharger, together with a geodetically higher heat exchanger, an inlet line and a return line, forms a further cooling circulation which is maintained by thermo-syphoning action after turning off the internal combustion engine.

The throughflow of a cooling circulation setting in after turning off of the internal combustion engine which is maintained by thermo-syphoning action, i.e., by different density of the hot and cooled cooling liquid cooled off in a heat exchanger, assures that the temperature of the turbocharger drops off continuously. Its lubricating oil suffers no temperature conditioned damages; its length of life can thus be considerably increased in a most simple manner.

In an advantageous construction of the present invention, the shifting over to thermo-syphoning cooling can take place by a solenoid valve installed into this cooling circulation, which is actuatable by a switching contact of the ignition starter switch.

According to the present invention an expansion tank or vessel is preferably used as heat exchanger for the thermo-syphoning cooling circulation, which establishes a volumetric equalization of colder to hotter cooling liquid in known cooling systems of internal combustion engines and is customarily installed into a connecting line from the radiator outlet to the radiator inlet. In order that the expansion vessel can better fulfill its task as heat exchanger, according to another feature of the present invention it may be provided externally with cooling ribs. Additionally, according to still a further feature of the present invention, also the return line to the turbocharger may be provided externally with cooling disks.

Since the geodetic height difference between the highest and the lowest point of the cooling line is determinative for the thermo-syphoning action, the expansion vessel is arranged as high as possible above the turbocharger. The connecting nipples for the liquid discharge and inlet are arranged at the turbocharger offset in height in order to also gain thereby an additional height difference.

These and other objects, features and advantages of the present invention will become more apparent from the following description when taken in connection with the accompanying drawing, which shows, for purposes of illustration only, one embodiment in accordance with the present invention, and wherein:

The single FIGURE is a schematic view of a cooling system in accordance with the present invention illustrated in block diagram.

Referring now to the single FIGURE of the drawing, the liquid pump 1 is flangedly connected to the crankcase 2 of a reciprocating piston internal combustion engine in order to feed cooling liquid through the cooling channels of the crankcase 2 and in the reverse direction through cooling channels of the cylinder head 3, from where it is fed by way of a return line 4 to the inlet side 5 of a radiator 6. While flowing through the radiator 6 which is acted upon by a fan 7, the cooling liquid cools off and leaves at the outlet or discharge side 8 of the radiator 6. The cooling liquid reaches by way of a line 9 a thermostat valve 10 which permits the cooling liquid to enter a line 11 to the liquid pump 1 dependent on the level of the temperature. If the temperature is lower than about 80° C., the inlet of the thermostat valve 10 on the radiator side closes and the cooling liquid flows through the bypass line 12 back to the thermostat valve 10 without flowing through the radiator 6.

A heating line 13 branches off from the cylinder head 3 to the vehicle heating system which leads to a heating heat exchanger 14 and from there to the thermostat valve 10.

In order to create an expansion possibility for the volume of the cooling liquid, an expansion tank or vessel 16 is connected to the inlet side 5 of the radiator 6 by means of a line 15, whereby the expansion vessel 16 is filled with cooling liquid up to a level 17. An inlet line 18 from the outlet connection 19 of a turbocharger 20 terminates in the expansion vessel 16 below the level 17, whereby the place of the discharge location of the line 18 is adapted to be closed off by a check valve 21. In lieu of the check valve 21, a remotely controlled solenoid valve 22 may also be installed into the inlet line 18. A line 23 leading to the outlet side 8 of the radiator 6 is connected to the bottom of the expansion vessel 16, which line continues in a return line 24 to the inlet connection 25 of the turbocharger 20.

Intermediate the solenoid valve 22 and the discharge connection 19 the inlet line 18 is connected with line 11 from the thermostat valve 10 to the liquid pump 1 by means of a connecting line 26. The discharge location 27 of the connecting line 26 lies directly upstream of the liquid pump 1, on the suction side thereof, and is constructed nozzle shaped in order to lower the pressure as far as possible by ejector action and to obtain as high a pressure drop as possible by way of the turbocharger 20 to the outlet side 8 of the radiator 6. A regulating thermostat 28 is installed into the connecting line 26, which so regulates the volume of the flow of the cooling liquid as a function of temperature that with a cold internal combustion engine a relatively small throughflow takes place whereas after warm-up of the engine a maximum throughflow takes place. It is prevented in this manner that during the warm-up of the internal combustion engine cold cooling liquid out of the turbocharger is mixed to its cooling circulation and thus the warm-up is delayed. If the cooling liquid has reached a predetermined temperature, then the regulating thermostat 28 opens up so far that the cooling circulation of the turbocharger which is formed during the operation of the internal combustion engine by the lines 23, 24 and 26, is fully traversed by cooling liquid; the check valve 21 or in lieu thereof, the solenoid valve 22 prevents that cooling liquid is removed out of the expansion vessel 16 by way of the line 18 in bypassing relationship of the turbocharger 20.

If the internal combustion engine and therewith also the liquid pump 1 is turned off, then a pressure equalization occurs in the entire cooling circulatory system of the internal combustion engine and the forced circulatory cooling is terminated. If during the turning off of the internal combustion engine, for example, by means of the ignition starter switch, the solenoid valve 22 is opened, then the hot cooling liquid of the turbocharger 20 can rise through the inlet line 18 to the expansion tank 16, cools off within the same and flows back through the return line 24 into the inlet connection 25 of the turbocharger 20. This thermo-syphoning flow assures a rapid cooling off of the turbocharger 20 so that an overheating of the bearing oil is avoided.

This type of cooling is the more effective the smaller the flow resistence in the cooling circulation and the larger the geodetic height difference between hot and cooled-off cooling liquid. The cooling liquid is so guided by a special construction of the flow channels in the expansion vessel 16 that it traverses the expansion vessel 16 along a long flow path in order to thus render as long as possible its hold-up time and cooling off time. For increasing the cooling action the expansion vessel 16 is provided on its outside with cooling ribs 29 and the return line 24 with cooling disks 30.

The thermo-syphoning cooling circulation operates only if the discharge location of the inlet line 18 in the expansion vessel 16 lies below the level 17. In order to call the attention of the driver of the motor vehicle to a non-permissibly low level 17, and to cause him to refill the expansion vessel 16, the level 17 is monitored by a monitoring and indicating apparatus of any known type.

While we have shown and described only one embodiment in accordance with the present invention, it is understood that the same is not limited thereto but is susceptible of numerous changes and modifications as known to those skilled in the art and we therefore do not wish to be limited to the details shown and described herein but intend to cover all such changes and modifications as are accomplished by the scope of the appended claims.

We claim:

1. A liquid cooling system for an internal combustion engine supercharged by a turbocharger, comprising forced circulation means effected by pump pressure, a radiator having an inlet and outlet, the turbocharger being operatively connected with the forced circulation between the radiator and the internal combustion engine, the turbocharger together with a geodetically higher heat exchanger, an inlet line means and a return line means forming a further cooling circulation which is maintained by thermo-syphoning action after the internal combustion engine is turned off.

2. A cooling system according to claim 1, wherein an expansion vessel means is used as heat exchanger for the temperature-conditioned, different volume of the cooling liquid, said expansion vessel means being filled with cooling liquid up to a predetermined level.

3. A cooling system according to claim 2, wherein the expansion vessel means is operatively connected above said level to the inlet side of the radiator, is connected below said level by the inlet line means to an outlet connection of the turbocharger as well as by the return line means to an inlet connection of the turbocharger.

4. A cooling system according to claim 3, wherein a check valve is inserted into the inlet line means which prevents the return flow from the expansion vessel means to a connecting line means operatively connecting the inlet line means with the suction side of the pump.

5. A cooling system according to claim 3, wherein the inlet line means includes a solenoid valve which is actuatable by an ignition starter switch of the internal combustion engine.

6. A cooling system according to claim 3, wherein the expansion vessel means is provided along its outside the cooling ribs.

7. A cooling system according to claim 6, wherein the return line means includes cooling disk means on the outside thereof.

8. A cooling system according to claim 7, wherein said cooling disk means are disposed substantially parallel.

9. A cooling system according to claim 7, wherein said cooling disk means extend helically shaped.

10. A cooling system according to claim 2, wherein a check valve is inserted into the inlet line means which prevents the return flow from the expansion vessel means to a connecting line means operatively connecting the inlet line means with the suction side of the pump.

11. A cooling system according to claim 2, wherein the inlet line means includes a solenoid valve which is actuatable by an ignition starter switch of the internal combustion engine.

12. A cooling system with a liquid pump according to claim 1, wherein the liquid pump which supplies cooling liquid through cooling channels of the engine crankcase, back through the cylinder head and by way of a return line to the inlet side of the radiator, is operatively connected by way of a thermostat valve means with the outlet side of the radiator, and in which the inlet line means is operatively connected by way of a connecting line means with a line leading from the thermostat valve means to the liquid pump.

13. A cooling system according to claim 12, wherein a regulating thermostat means is installed in the connecting line means which so regulates the volumetric flow as a function of the temperature of the cooling liquid that with a cold internal combustion engine relatively little throughflow takes place whereas with a warm internal combustion engine maximum throughflow takes place.

14. A cooling system according to claim 13, wherein the discharge place of the connecting line means in the line leading to the liquid pump is constructed nozzle shaped in the manner of an ejector.

15. A cooling system according to claim 12, wherein the discharge place of the connecting line means in the line leading to the liquid pump is constructed nozzle shaped in the manner of an ejector.

16. A cooling system according to claim 12, wherein an expansion vessel means is used as heat exchanger for the temperature-conditioned, different volume of the cooling liquid, said expansion vessel means being filled with cooling liquid up to a predetermined level.

17. A cooling system according to claim 16, wherein the expansion vessel means is operatively connected above said level to the inlet side of the radiator, is connected below said level by the inlet line means to an outlet connection of the turbocharger as well as by the return line means to an inlet connection of the turbocharger.

18. A cooling system according to claim 17, wherein a regulating thermostat means is installed in the connecting line means which so regulates the volumetric flow as a function of the temperature of the cooling liquid that with a cold internal combustion engine relatively little throughflow takes place whereas with a warm internal combustion engine maximum throughflow takes place.

19. A cooling system according to claim 2, wherein the expansion vessel means is provided along its outside the cooling ribs.

20. A cooling system according to claim 1, wherein the return line means includes cooling disk means on the outside thereof.

* * * * *